US011178912B2

(12) United States Patent
Zeng et al.

(10) Patent No.: US 11,178,912 B2
(45) Date of Patent: Nov. 23, 2021

(54) DEVICE CAPABLE OF AUTOMATICALLY IGNITING OR HEATING A CIGARETTE

(71) Applicant: CHINA TOBACCO YUNNAN INDUSTRIAL CO., LTD, Kunming (CN)

(72) Inventors: Xu Zeng, Kunming (CN); Jianguo Tang, Kunming (CN); Ping Lei, Kunming (CN); Shanzhai Shang, Kunming (CN); Dalin Yuan, Kunming (CN); Xudong Zheng, Kunming (CN); Jingmei Han, Kunming (CN); Zhiqiang Li, Kunming (CN); Chengya Wang, Kunming (CN); Ru Wang, Kunming (CN); Yupeng Gong, Kunming (CN); Weimin Gong, Kunming (CN); Kunrong Shi, Kunming (CN); Zhihong Tan, Kunming (CN); Yongkuan Chen, Kunming (CN)

(73) Assignee: CHINA TOBACCO YUNNAN INDUSTRIAL CO., LTD, Kunming (CN)

( * ) Notice: Subject to any disclaimer, the term of this patent is extended or adjusted under 35 U.S.C. 154(b) by 149 days.

(21) Appl. No.: 16/642,024

(22) PCT Filed: Sep. 10, 2018

(86) PCT No.: PCT/CN2018/104873

§ 371 (c)(1),
(2) Date: Feb. 26, 2020

(87) PCT Pub. No.: WO2019/047955

PCT Pub. Date: Mar. 14, 2019

(65) Prior Publication Data

US 2020/0205475 A1 Jul. 2, 2020

(30) Foreign Application Priority Data

Sep. 11, 2017 (CN) ..... 201710814141.0

(51) Int. Cl.
*A24F 13/00* (2006.01)
*A24F 40/60* (2020.01)
(Continued)

(52) U.S. Cl.
CPC ..... *A24F 40/60* (2020.01); *A24D 1/20* (2020.01); *A24F 15/01* (2020.01); *A24F 40/40* (2020.01);
(Continued)

(58) Field of Classification Search
CPC ..... A24F 47/00
(Continued)

(56) References Cited

U.S. PATENT DOCUMENTS 6,164,287 A 12/2000 White
2011/0226236 A1* 9/2011 Buchberger ..... A61K 31/465 128/200.23
2018/0303161 A1* 10/2018 Bilat ..... A24F 40/40

FOREIGN PATENT DOCUMENTS

CN 1303636 A 7/2001
CN 103549657 A 2/2014
(Continued)

*Primary Examiner* — Phuong K Dinh
(74) *Attorney, Agent, or Firm* — Bayramoglu Law Offices LLC

(57) ABSTRACT

A device capable of automatically igniting or heating a cigarette includes a heat source system, a control system, and the openable and closeable top cover. The heat source system includes the electric heating chamber and the igniter. The igniter includes the electric heating element. The electric heating chamber includes at least one pair of light passing holes of the electric heating chamber. The control system includes the control circuit board, the mechanical
(Continued)

switch, the mode switching switch, the infrared light source, the light sensing switch, and the device main circuit switch. The mechanical switch controls the top cover to be opened or closed and controls the device main circuit switch to be turned on or off. The mode switching switch is used for switching between an operation of the igniter and an operation of the electric heating chamber.

15 Claims, 1 Drawing Sheet

(51) Int. Cl.

| | |
|---|---|
| ***A24F 40/40*** | (2020.01) |
| ***A24F 40/50*** | (2020.01) |
| ***A24D 1/20*** | (2020.01) |
| ***A24F 15/01*** | (2020.01) |
| ***A24F 40/46*** | (2020.01) |
| *A24F 40/20* | (2020.01) |

(52) U.S. Cl.
CPC ..... *A24F 40/46* (2020.01); *A24F 40/50* (2020.01); *A24F 40/20* (2020.01)

(58) Field of Classification Search
USPC ..... 131/328–329
See application file for complete search history.

(56) References Cited

FOREIGN PATENT DOCUMENTS

| | | | |
|---|---|---|---|
| CN | 103859586 | A | 6/2014 |
| CN | 204180943 | U | 3/2015 |
| CN | 105852223 | A | 8/2016 |
| CN | 107692317 | A | 2/2018 |
| CN | 207383531 | U | 5/2018 |
| WO | 9963844 | A1 | 12/1999 |

* cited by examiner

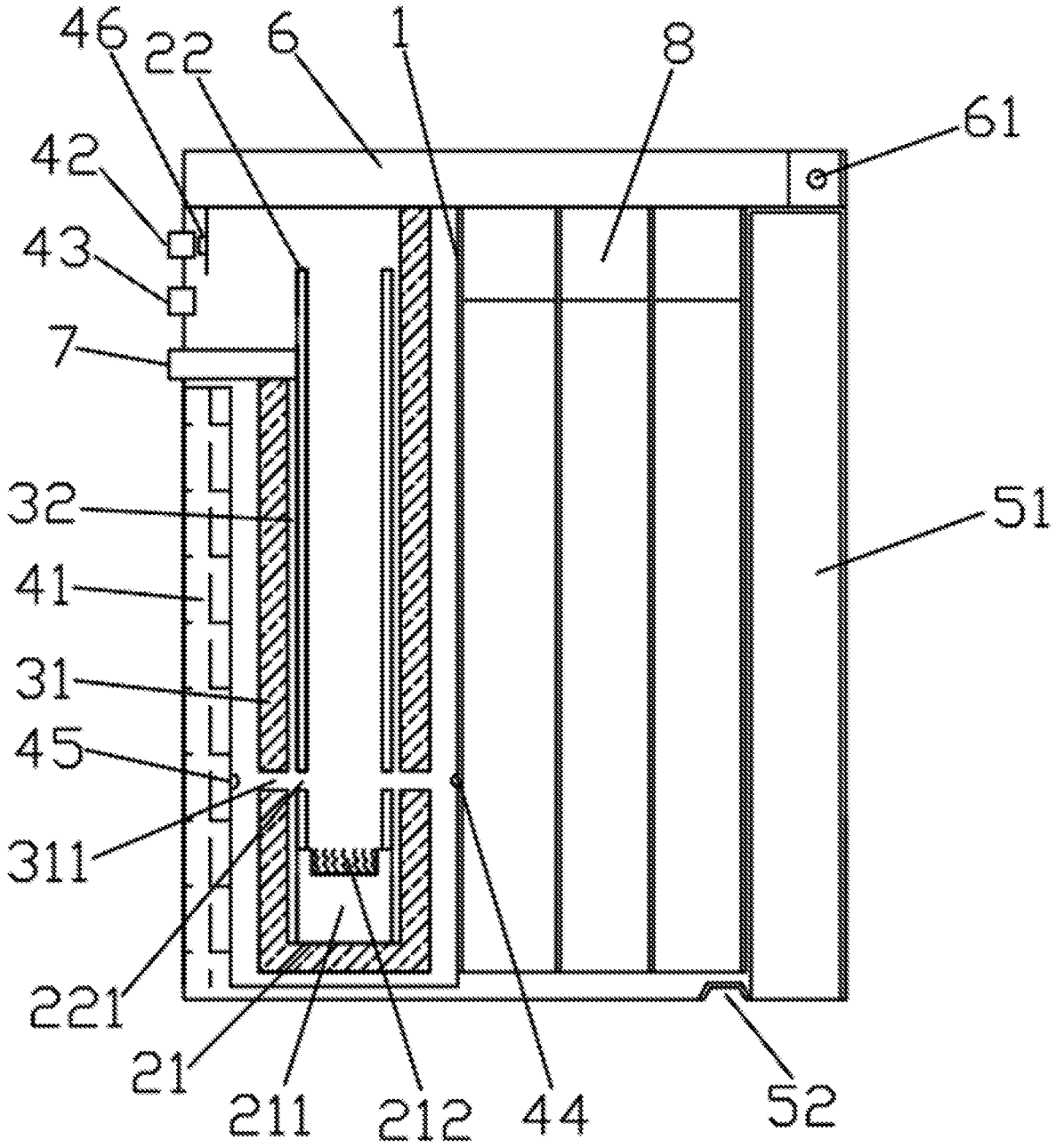
46
22
6
1
8
61
42
43
7
32
51
41
31
45
311
221
21
211
212
44
52

DEVICE CAPABLE OF AUTOMATICALLY IGNITING OR HEATING A CIGARETTE

CROSS REFERENCE TO THE RELATED APPLICATIONS

This application is the national phase entry of International Application No. PCT/CN2018/104873, filed on Sep. 10, 2018, which is based upon and claims priority to Chinese Patent Application No. 201710814141.0, filed on Sep. 11, 2017, the entire contents of which are incorporated herein by reference.

TECHNICAL FIELD

The present disclosure belongs to the field of smoking devices, and specifically relates to a device capable of automatically igniting or heating a cigarette.

BACKGROUND

In recent years, new-type tobacco products have developed rapidly, especially new-type electric heating cigarettes. These products have been increasingly well received by consumers. Among all the new-type tobacco products, the new-type carbon-heated cigarette is closest to conventional cigarettes in terms of the raw material, appearance and smoking method. But the carbon-heated cigarette differs from conventional end-ignition type cigarettes in that the carbon rod end is arranged at the end of the cigarette rod. After the carbon rod is ignited, the cigarette rod is conductively heated or convectively heated by the heat or hot air generated by the combustion of the carbon rod so that the smoking materials release smoke for users to smoke. The new-type carbon-heated cigarette maintains the appearance and smoking method that smokers use in conventional cigarettes and conforms to the smoking habits of traditional smokers. Users find them more convenient to carry and use as well.

However, the new-type carbon-heated cigarette, like conventional cigarettes, needs to ignite the front end of the cigarette for smoking when in use. Namely, the cigarette needs to be taken out from a cigarette case and ignited by a lighter or a match for smoking, which causes an inconvenience of carrying a cigarette case and a lighter or a match at the same time. The cigarette is ignited under open flames, which poses safety hazards such as a fire risk. Moreover, the combustion of alkanes in the lighter and matches causes a pollution to the environment.

There is a need, therefore, for an integrated smoking device that can provide three types of smoking functions of conventional cigarettes, carbon-heated cigarettes, and electric heating cigarettes to facilitate carrying.

The present disclosure is directed toward this need.

SUMMARY

A first aspect of the present disclosure provides a device capable of automatically igniting or heating a cigarette, including a heat source system, a control system, and the openable and closeable top cover (6), wherein:

The heat source system includes the electric heating chamber (22) and the igniter (21) located at the bottom of the electric heating chamber (22). The igniter (21) includes the electric heating element (212); and the electric heating chamber (22) includes at least a pair of light passing holes (221) penetrating a wall of the electric heating chamber.

The control system includes the control circuit board (41), the mechanical switch (42), the mode switching switch (43), the infrared light source (44), the light sensing switch (45) and the device main circuit switch (46). The mechanical switch (42) controls the top cover (6) to be opened or closed and controls the device main circuit switch (46) to be turned on or off. The mode switching switch (43) is used for switching between an operation of the igniter (21) and an operation of the electric heating chamber (22). The infrared light source (44), the light sensing switch (45), and the light passing holes (221) of the electric heating chamber are aligned with one another. The light sensing switch (45) controls the igniter (21) or the electric heating chamber (22) to be powered on or off.

The electric heating chamber (22) itself is an electric heating element, or a side wall of the electric heating chamber is provided with other electric heating elements in order to achieve the electric heating function without the aid of the electric heating element (212) on the igniter (21).

In a preferred embodiment of the first aspect of the present disclosure, the thermal insulation layer (31) is arranged outside the electric heating chamber (22), and the air chamber (32) is selectively arranged between the electric heating chamber (22) and the thermal insulation layer (31). The air chamber (32) plays a role of auxiliary thermal insulation.

In a preferred embodiment of the first aspect of the present disclosure, the device further includes the auxiliary cigarette accommodation case (1), in which the auxiliary cigarette 8 is accommodated.

In a preferred embodiment of the first aspect of the present disclosure, at least one pair of light passing holes (331) of the thermal insulation layer are arranged on the thermal insulation layer (31). The at least one pair of light passing holes (331) of the thermal insulation layer are aligned with the at least one pair of light passing holes (221) of the electric heating chamber so that the infrared light emitted by the infrared light source 44 can reach the light sensing switch 45 via the light passing hole (221) of the electric heating chamber and the light passing hole (331) of the thermal insulation layer without being affected.

In a preferred embodiment of the first aspect of the present disclosure, the device further includes the battery (51) and/or the charging interface (52). The battery (51) and/or the charging interface (52) is used to power the entire device.

In a preferred embodiment of the first aspect of the present disclosure, the electric heating chamber (22) is arranged in a manner allowing the electric heating chamber (22) to slidably extend or retract relative to the device, which can be achieved by the following manner: the device further includes the electric heating chamber sliding button (7), and the electric heating chamber sliding button (7) is fixed on an outer wall of the electric heating chamber and extends outside the device. The electric heating chamber (22) slidably extends or retracts relative to the device by manually pushing the electric heating chamber sliding button 7. The electric heating chamber extends a distance so that the ignition end of the carbon-heated cigarette or conventional cigarette inserted in the electric heating chamber is slightly away from the bottom of the electric heating element (212), which facilitates the ignition and avoids a temperature rise of the electric heating chamber in that the igniter is excessively close to the lower bottom of the electric heating chamber when igniting.

A second aspect of the present disclosure relates to a method of automatically igniting or heating a cigarette. The method uses the device in the first aspect of the present disclosure and includes the following steps:

1) pressing the mechanical switch (42), unlocking a snap buckle of the top cover to open the top cover (6), meantime, triggering the device main circuit switch (46) so that a main circuit of the device is connected; operating the infrared light source (44) to emit an infrared light, wherein the infrared light reaches the light sensing switch (45) via the light passing hole (221) of the electric heating chamber; then setting the mode switching switch (43) according to a type of a cigarette to be smoked; if the cigarette to be smoked is a carbon-heated cigarette or an end-ignition type cigarette, setting an ignition mode, in which the ignition mode, only the igniter (21) can be powered on to operate, and the electric heating chamber (22) cannot be powered on to operate; alternatively, if the cigarette to be smoked is an electric heating cigarette, setting a heating mode, in which the heating mode, only the electric heating chamber (22) can be powered on to operate and the igniter (21) cannot be powered on to operate; at this time, entering a standby state of the entire device;

2) inserting the cigarette to be smoked into the electric heating chamber (22), when the cigarette blocks the infrared light, according to a mode setting of the mode switching switch (43), activating the igniter (21) to be powered on to operate to ignite an insertion end of the cigarette to be smoked by the light sensing switch (45), or activating the electric heating chamber (22) to be powered on to operate to circumferentially heat the cigarette to be smoked by the light sensing switch (45); and entering a working state of the device.

In a preferred embodiment of the second aspect of the present disclosure, the method of automatically igniting or heating the cigarette further includes the following step:

3) sensing the infrared light and restoring the device to the standby state by the light sensing switch (45) after the cigarette to be smoked is removed from the electric heating chamber.

In a preferred embodiment of the second aspect of the present disclosure, the method of automatically igniting or heating the cigarette further includes the following step:

4) cutting off a main circuit of the entire device by the device main circuit switch (46) after the top cover (6) is closed, and entering an off state of the entire device.

The advantages of the present disclosure are as follows:

The present disclosure provides consumers with a device capable of automatically igniting or heating a cigarette. The unique light sensing structure and control system design are configured to sense the action of inserting and removing cigarettes by consumers and automatically heat the new-type circumferential heating type electric heating type cigarette or automatically ignite the new-type carbon-heated cigarette and conventional end-ignition type cigarette and thus the device of the present disclosure is a "three-in-one" type integrated smoking device. The device for automatically igniting or heating a cigarette uses the electric heating element to generate heat when powered on at a safe voltage, and can easily ignite or heat a cigarette under a hidden situation without open flames, which avoids unsafe conditions such as a fire risk caused by using a lighter or a match to ignite the conventional cigarette under open flame conditions, and avoids environmental pollution caused by the combustion of alkanes in the lighter or the matches. Moreover, the device can also accommodate a certain number of cigarettes, which realizes the functional integration of cigarette accommodation, cigarette ignition or heating tools, and hidden type ignition without open flames or heating function. The device is easy to carry and use. In addition, when the consumer removes the cigarette and does not insert a new cigarette within a specified time, the power can be automatically turned off due to the safety design of the control system, which ensures safety and saves energy.

BRIEF DESCRIPTION OF THE DRAWINGS

FIGURE shows a structural schematic diagram of the device capable of automatically igniting or heating a cigarette according to the present disclosure.

DESCRIPTION OF NUMERAL REFERENCES

1: auxiliary cigarette accommodation case; 21: igniter; 211: igniter base; 212: electric heating element; 22: electric heating chamber; 221: light passing hole of the electric heating chamber; 31: thermal insulation layer; 311: light passing hole of the thermal insulation layer; 32: air chamber; 41: control circuit board; 42: mechanical switch; 43: mode switching switch; 44: infrared light source; 45: light sensing switch; 46: device main circuit switch; 51: battery; 52: charging interface; 6: top cover; 61: top cover rotating shaft; 7: electric heating chamber sliding button; 8: auxiliary cigarette.

DETAILED DESCRIPTION OF THE EMBODIMENTS

The technical solution in the embodiments of the present disclosure will be clearly and completely described hereinafter with reference to FIG. 1. Obviously, the described embodiments are only a part of the embodiments of the present disclosure rather than all the embodiments. Based on the embodiments of the present disclosure, all other embodiments obtained by those skilled in the art without creative efforts shall fall within the scope of protection of the present disclosure.

As shown in FIG. 1, the device capable of automatically igniting or heating a cigarette of the present disclosure mainly includes a heat source system, a control system, and the openable and closable top cover 6, and selectively includes a power supply system, a thermal insulation system, and the auxiliary cigarette accommodation case 1.

The heat source system includes the igniter 21 and the electric heating chamber 22. The igniter 21 includes the igniter base 211 and the electric heating element 212. The electric heating chamber 22 includes an outer layer and an inner layer. The outer layer of the electric heating chamber is made of a high-temperature-resistant thermal insulation material, and the inner layer of the electric heating chamber is made of a high-temperature-resistant material having a high thermal conductivity. The length of the electric heating chamber is equal to the length of the tobacco section of the new-type electric heating cigarette (the length of the tobacco section of the new-type electric heating cigarette is shorter than the length of the new-type carbon-heated cigarette and the conventional cigarette). The lower part of the electric heating chamber is provided with two light passing holes 221 of the electric heating chamber which are opposite to each other, and the centers of the two light passing holes are aligned with the light emitting point of the infrared light source 44 and the light receiving point of the light sensing switch 45. The core component of the igniter 21 is the electric heating element 212. The electric heating chamber 22 can generate heat when powered on. When the electric heating chamber is powered on, the temperature of the electric heating element of the igniter rapidly rises, and the electric heating element is in a red-hot state and ignites the ignition end of the new-type carbon-heated cigarette or the conventional cigarette. Alternatively, the electric heating chamber 22 generates heat to circumferentially heat the tobacco section of the new-type electric heating cigarette.

The thermal insulation system 3 mainly includes the thermal insulation layer 31 and the air chamber 32 that is arranged selectively. The lower part of the thermal insulation layer is provided with two light passing holes 311 opposite to each other, and the centers of the two light passing holes are aligned with the light emitting point of the infrared light source and the light receiving point of the light sensing switch.

It should be noted that, the lower part of the electric heating chamber 22 and the lower part of the thermal insulation layer 31 are respectively provided with two light passing holes 221 and two light passing holes 311 aligned with the infrared light source and the receiving point of the light sensing switch. In order to visually exhibit the light passing holes and the light propagation path, the light passing holes are shown in the figure. In fact, the electric heating chamber 22 and the thermal insulation layer 31 are not disconnected, and are both provided with two light passing holes at corresponding positions.

The control system includes the control circuit board 41 (hereinafter, a printed circuit board assembly (PCBA) control center is taken as an example), the mechanical switch 42, the mode switching switch 43, the infrared light source 44, the light sensing switch 45, and the device main circuit switch 46. The PCBA control center is the center of the control system. The PCBA control center correspondingly responds to the action of the mechanical switch and controls the device main circuit to be connected or disconnected. The PCBA control center correspondingly responds to the action of the mode switching switch to allow the device to be in an ignition mode (in which the igniter 21 of the heat source system can operate, while the electric heating chamber 22 cannot operate) or a heating mode (in which the electric heating chamber 22 of the heat source system can operate, and the igniter 21 cannot operate). The PCBA control center correspondingly responds to the feedback of the light sensing switch to control the heat source system circuit to be connected or disconnected. The PCBA control center also regulates the safety protection functions (such as short circuit protection, overcharge protection, low voltage protection, timeout protection, etc.) of the entire device circuit. If the device is short-circuited or overcharged when charged externally, the control system automatically disconnects the device circuit. If the device is short-circuited or over discharged (low voltage) when discharged, the control system automatically disconnects the device circuit. When the mechanical switch is pressed, the top cover of the device is opened, if the heat source system is not actuated within 30 seconds after the device main circuit is turned on, the control system automatically disconnects the device main circuit and turns off the device. When the device main circuit and the heat source system are turned on, if the igniter of the heat source system is activated for 10 seconds or the electric heating chamber of the heat source system is activated for 330 seconds, the control system automatically disconnects the heat source system circuit, and the device main circuit remains connected. If the igniter of the heat source system is activated for 10 seconds or the electric heating chamber of the heat source system is activated for 330 seconds, and another cigarette is inserted within 30 seconds after the heat source system circuit is automatically disconnected, the heat source system is reconnected by the control system to operate again (to achieve a function of continuously igniting or heating multiple cigarettes). If the igniter of the heat source system is activated for 10 seconds or the electric heating chamber of the heat source system is activated for 330 seconds, and the cigarette is not inserted within 30 seconds after the heat source system circuit is automatically disconnected (i.e., the heat source system circuit is not reconnected), then the control system automatically disconnects the device main circuit and turns off the device. Each time the mechanical switch is pressed to open the top cover of the device, the device main circuit is connected; each time the top cover of the device is closed, the heat source system circuit and the device main circuit are disconnected, and the device is turned off.

The power supply system includes the battery 51 and/or the charging interface 52. The power supply system 5 provides electric energy for the entire device, and has a large electric capacity. The charging interface 52 can use an external power supply to quickly charge the power supply system of the device.

The auxiliary cigarette accommodation case 1 is a case-type chamber made of a high-temperature-resistant thermal insulation material having a low thermal conductivity, and can store several auxiliary cigarettes 8.

The working process of the device of the present disclosure is as follows:

In the initial state, when the mechanical switch 42 is not pressed and the top cover 6 of the device is not opened, the entire device main circuit is in an off state, the infrared light source 44 does not operate and does not emit light; when the mechanical switch 42 is pressed, the top cover 6 of the device is opened, at the same time, the mechanical switch triggers the device main circuit switch 46, the entire device main circuit is connected, the infrared light source 44 operates and emits light normally. Since the cigarette is not inserted, the light sensing switch 45 receives the light emitted by the infrared light source, the heat source system is in the off state, and the heat source system is not activated. When the device main circuit is connected and the cigarette is inserted in place, the lower part of the cigarette is located between the infrared light source 44 and the light sensing switch 45 to block the light propagation path between the two light passing holes 221 which are opposite to each other and formed in the lower part of the electric heating chamber, and block the light emitted by the infrared light source, and the light sensing switch 45 cannot normally receive the light. At this time, the heat source system circuit is connected and the heat source system starts to operate (according to the mode of the mode switching switch 43, the igniter 21 of the heat source system operates, the temperature of the igniter rapidly rises, and the igniter is in a red-hot state to ignite the ignition end of the new-type carbon-heated cigarette or the conventional cigarette; alternatively, the electric heating chamber 22 of the heat source system operates and rapidly generates heat to circumferentially heat the tobacco section of the new-type electric heating cigarette). After the cigarette is ignited or heated by the heat source system (the new-type circumferential heating type electric heating cigarette needs to be placed in the electric heating chamber to be smoked while heated), the cigarette is taken out. When the cigarette is taken out until the lower part of the cigarette is away from the two light passing holes 221 opposite to each other and opened in the lower part of the electric heating chamber without blocking the light propagation path between the two light passing holes, the cigarette does not block the light emitted by the infrared light source. The light sensing switch is restored to receive the light emitted by the infrared light source. The heat source system circuit is disconnected and stops operating and the device main circuit is still connected. If the cigarette is inserted again, the heat source system circuit will be reconnected, and the heat source system will operate again. If the top cover of the device is closed, the mechanical switch triggers the device main circuit switch again. The heat source system circuit and the device main circuit will be disconnected at the same time, and the device is turned off.

Preferably, the electric heating chamber sliding button 7 may be additionally arranged, and the electric heating chamber is designed as a chamber that can slide upward by a certain distance (the electric heating chamber 22 can slide upward by a certain distance and restore the initial position by the electric heating chamber sliding button 7). The four light passing holes, aligned with one another and arranged at the lower part of the electric heating chamber and the lower part of the thermal insulation material outside the electric heating chamber, are located 8 mm from the bottom end of the electric heating chamber (so as to clearly determine whether the cigarette is inserted or removed). The diameter of the light passing hole is equal to or smaller than 2 mm, and the sliding distance is preferably 3 mm-6 mm (to ensure that the bottom end of the electric heating chamber can still completely block the light propagation path between the infrared light source and the light sensing switch after the electric heating chamber slides upward to the maximum distance, so as to ensure that the light emitted by the infrared light source is not received by the light sensing switch). In this way, when the new-type carbon-heated cigarette or the conventional cigarette is smoked (the mode switching switch of the device is in the ignition mode), since the electric heating chamber moves upward by a certain distance, the bottom end of the electric heating chamber is not aligned with the ignition end of the cigarette. Namely, the ignition end of the cigarette is not surrounded by the lower part of the electric heating chamber, and is exposed outside the electric heating chamber, so that the igniter can more easily and quickly ignite the ignition end of the cigarette.

There is a certain distance between the igniter and the bottom end of the heating chamber, so that the igniter does not directly heat the bottom of the electric heating chamber to increase the temperature of the electric heating chamber (due to the use of the new-type carbon-heated cigarettes or conventional cigarettes, the mode switching switch is in the ignition mode, the electric heating chamber does not operate. At this time, the electric heating chamber only plays a role of accommodating and positioning the cigarette to be ignited). When the new-type circumferential heating type electric heating cigarette is smoked and the mode switching switch is in the heating mode, the electric heating chamber is in the initial position and does not move upward. When the new-type carbon-heated cigarette or the conventional cigarette is smoked and the mode switching switch is in the ignition mode, the electric heating chamber moves upward by a predetermined distance when the new-type carbon-heated cigarette or the conventional cigarette is inserted (the electric heating chamber can move upward only when the mode switching switch of the device is in the ignition mode and the new-type carbon-heated cigarette or the conventional cigarette is inserted or after the new-type carbon-heated cigarette or the conventional cigarette is inserted, preferably when the cigarette is inserted, the electric heating chamber moves upward; otherwise, the electric heating chamber moves upward to block the light propagation path between the infrared light source and the light sensing switch, the light sensing switch cannot receive the light emitted by the infrared light source, and the PCBA control center will determine that the cigarette has been inserted to connect the heat source system circuit and activate the heat source system by default). The upward movement distance of the electric heating chamber is preferably set to 3 mm-6 mm. After the new-type carbon-heated cigarette or the conventional cigarette is ignited by the igniter, the electric heating chamber should be moved downward to the initial position in time, and then the new-type carbon-heated cigarette or the conventional cigarette should be taken out immediately (if the ignited cigarette is taken out directly, the electric heating chamber is in a position after moving upward, and the lower part of the electric heating chamber blocks the light propagation path between the infrared light source and the light sensing switch. Namely, after the ignited cigarette is ignited and removed, since the light sensing switch cannot receive the light emitted by the infrared light source, the igniter of the heat source system continues to operate when the igniter is activated for less than 10 seconds, which causes a waste of energy and generates undesirable heat. Therefore, the ideal situation is as follows: before or while the ignited new-type carbon-heated cigarette or the conventional cigarette is removed, the electric heating chamber moves downward to return to the initial position, and then the new-type carbon-heated cigarette or the conventional cigarette is removed from the electric heating chamber).

Preferably, the space and size of the cigarette accommodation chamber 1 of the device can be designed according to the appearance size of the packaging cigarette case of the new-type carbon-heated cigarettes, conventional cigarettes or the new-type circumferential heating type electric heating cigarette. Namely, a pack of cigarettes packed by the packaging cigarette case, together with the cigarette case, can be placed in the cigarette accommodation chamber, which ensures the cleanliness and sanitation of the cigarettes placed in the cigarette accommodation chamber when the top cover of the device is opened (e.g., when the device is igniting or heating a cigarette).

The above-mentioned descriptions are only the preferred embodiments of the present disclosure, and are not intended to limit the present disclosure. Any modifications, equivalent replacements, or improvements made within the spirit and principle of the present disclosure shall fall within the scope of protection of the claims of the disclosure.

What is claimed is:

1. A device for automatically igniting or heating a cigarette, comprising:

a heat source system, a control system, and an openable and closeable top cover;

wherein:

the heat source system comprises an electric heating chamber and an igniter, wherein the igniter is located at a bottom of the electric heating chamber;

the igniter comprises an electric heating element;

the electric heating chamber comprises at least one pair of first light passing holes, wherein the at least one pair of first light passing holes penetrate a wall of the electric heating chamber; and the control system comprises a control circuit board, a mechanical switch, a mode switching switch, an infrared light source, a light sensing switch, and a device main circuit switch; wherein the mechanical switch controls the openable and closeable top cover to be opened or closed and controls the device main circuit switch to be turned on or off; the mode switching switch is configured to switch between an operation of the igniter and an operation of the electric heating chamber; the infrared light source, the light sensing switch, and the at least one pair of first light passing holes are aligned with one another; the light sensing switch controls the igniter or the electric heating chamber to be powered on or off.

2. The device according to claim 1, wherein: a thermal insulation layer is arranged outside the electric heating chamber, and an air chamber is arranged between the electric heating chamber and the thermal insulation layer.

3. The device according to claim 1, wherein: the device further comprises an auxiliary cigarette accommodation case.

4. The device according to claim 2, wherein: at least one pair of second light passing holes are arranged on the thermal insulation layer, and the at least one pair of second light passing holes are aligned with the at least one pair of first light passing holes.

5. The device according to claim 1, wherein: the device further comprises a battery and/or a charging interface.

6. The device according to claim 1, wherein: the electric heating chamber is arranged in a manner allowing the electric heating chamber to slidably extend or retract relative to the device.

7. The device according to claim 6, wherein: the device further comprises an electric heating chamber sliding button, and the electric heating chamber sliding button is fixed on an outer wall of the electric heating chamber and extends outside the device.

8. A method of automatically igniting or heating the cigarette by using the device according to claim 1, comprising the following steps:

step (1): pressing the mechanical switch, unlocking a snap buckle of the openable and closeable top cover to open the openable and closeable top cover, triggering the device main circuit switch, wherein a main circuit of the device is connected, the infrared light source works to emit an infrared light, and the infrared light reaches the light sensing switch via the at least one pair of first light passing holes; setting the mode switching switch according to a type of a cigarette to be smoked; if the cigarette to be smoked is a carbon-heated cigarette or an end-ignition type cigarette, setting an ignition mode, wherein only the igniter is powered on to operate in the ignition mode, and the electric heating chamber is not powered on to operate in the ignition mode; if the cigarette to be smoked is an electric heating cigarette, setting a heating mode, wherein only the electric heating chamber is powered on to operate in the heating mode, and the igniter is not powered on to operate in the heating mode; entering a standby state of the device; and step (2): inserting the cigarette to be smoked into the electric heating chamber, when the cigarette to be smoked blocks the infrared light, according to a mode setting of the mode switching switch, activating the igniter to be powered on to operate to ignite an insertion end of the cigarette to be smoked by the light sensing switch, or activating the electric heating chamber to be powered on to operate to circumferentially heat the cigarette to be smoked by the light sensing switch; and entering a working state of the device.

9. The method according to claim 8, wherein, the method further comprises the following step:

step (3): sensing the infrared light and restoring the device to the standby state by the light sensing switch after the cigarette to be smoked is removed from the electric heating chamber.

10. The method according to claim 8, wherein, the method further comprises the following step:

step (4) cutting off the main circuit of the device by the device main circuit switch after the openable and closeable top cover is closed, and entering an off state of the device.

11. The method according to claim 8, wherein: a thermal insulation layer is arranged outside the electric heating chamber, and an air chamber is arranged between the electric heating chamber and the thermal insulation layer.

12. The method according to claim 8, wherein: the device further comprises an auxiliary cigarette accommodation case.

13. The method according to claim 8, wherein: at least one pair of second light passing holes are arranged on the thermal insulation layer, and the at least one pair of second light passing holes are aligned with the at least one pair of first light passing holes.

14. The method according to claim 8, wherein: the device further comprises a battery and/or a charging interface.

15. The method according to claim 8, wherein: the electric heating chamber is arranged in a manner allowing the electric heating chamber to slidably extend or retract relative to the device.

* * * * *